US005233855A

United States Patent [19]

Maki et al.

[11] Patent Number: 5,233,855

[45] Date of Patent: Aug. 10, 1993

[54] POLYMERIC ANTI-EXTRUSION RINGS FOR ELASTOMERIC SWAGING

[75] Inventors: Robert L. Maki, Bothell; Todd W. Smith, Edmonds, both of Wash.

[73] Assignee: The Boeing Company, Seattle, Wash.

[21] Appl. No.: 792,569

[22] Filed: Nov. 15, 1991

[51] Int. Cl.[5] ..... B21D 9/15

[52] U.S. Cl. ..... 72/62; 72/58; 72/60; 72/370; 29/421.1

[58] Field of Search ..... 72/54, 56, 58, 59, 61, 72/62, 370; 29/421.1, 727, 237

[56] References Cited

U.S. PATENT DOCUMENTS

| | | | |
|---|---|---|---|
| 2,971,556 | 2/1961 | Armstrong et al. | 72/370 |
| 3,574,429 | 4/1971 | Reising | 308/238 |
| 4,006,619 | 2/1977 | Anderson | 72/58 |
| 4,068,372 | 1/1978 | Kamohara et al. | 72/58 |
| 4,320,568 | 3/1982 | Herrod et al. | 72/62 |
| 4,388,752 | 6/1983 | Vinciguerra et al. | 72/58 |
| 4,443,160 | 8/1977 | Baker et al. | 72/61 |
| 4,499,646 | 2/1985 | Allor et al. | 29/447 |
| 4,532,396 | 7/1985 | Burack et al. | 219/10.49 |

*Primary Examiner*—David Jones

*Attorney, Agent, or Firm*—Elizabeth F. Harasek; B. A. Donahue

[57] ABSTRACT

Polymeric anti-extrusion rings are provided for internal cooling of a drawbolt swaging apparatus. One such ring is located on either side of an elastomeric expansion sheath on a drawbolt. There rings are formed of polymeric material which has low creep, high tensile strength and is substantially unaffected at swaging temperatures. The rings are sized to fit snugly on the drawbolt shank and to provide minimum practical clearance with the interior dimensions of the tube to be swaged. The outer perimeter of the rings adjacent to the drawbolt head and bushing are chamfered.

4 Claims, 2 Drawing Sheets

Fig. 2
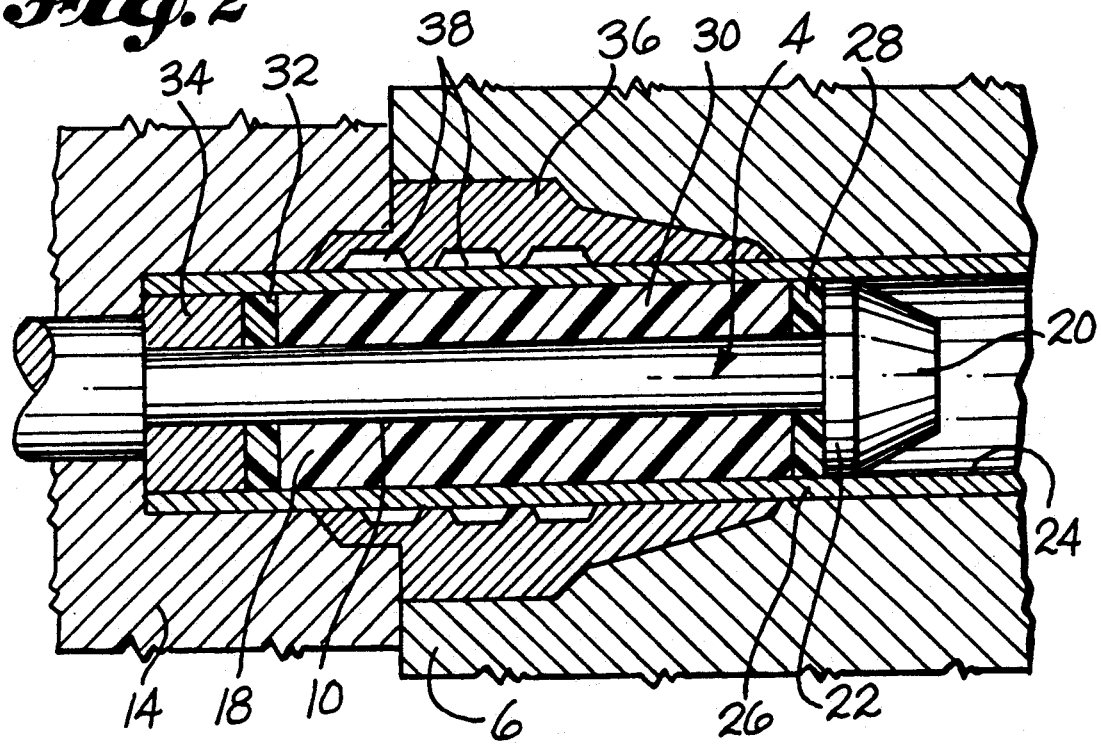
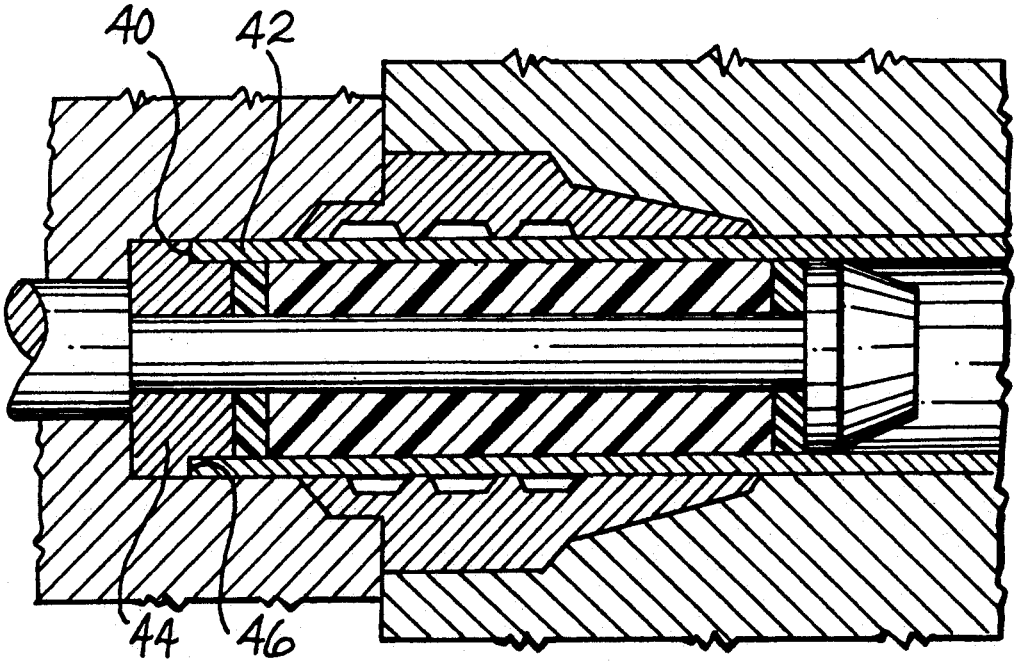
Fig. 3

POLYMERIC ANTI-EXTRUSION RINGS FOR ELASTOMERIC SWAGING

This invention relates to an improved drawbolt apparatus for swaging tubing, particularly soft metal tubing. More particularly, the invention relates to the use of specially adapted polymeric anti-extrusion rings on either end of a resilient expander for drawbolt swaging.

BACKGROUND

Elastomeric swaging is a process used to fasten end fittings onto tubes of steel, aluminum, copper or other deformable metals. This is commonly done by assembling a split steel anti-extrusion ring, an elastomeric expander sheath, another split steel ring and a bushing onto a drawbolt with an expanded head portion. This drawbolt assembly is positioned in the tube end, inserted in an end fitting and placed in the swaging die. The drawbolt is pulled towards or pushed against the bushing forcing the elastomeric sheath to compress and expand outward into the tube, forcing the tube into the grooves of the fitting. One such process and apparatus is described in U.S. Pat. No. 4,043,160, assigned to the assignee hereof.

During swaging, substantial force is exerted on the split steel rings. Generally, this does not cause a problem when swaging steel tubes, however the dislocation of these rings causes unacceptable scratching, cutting and nicking on the insides of softer metal tubes. We have also found that these split rings must be replaced every 10 to 15 cycles when swaging aluminum tubes.

In an effort to solve these problems, many different sizes, shapes and materials have been tried for anti-extrusion rings. Nylon anti-extrusion rings eliminated scoring inside aluminum and other soft metal tubes, but the rings were too long, sacrificing the useful length of the elastomeric expander. Short nylon anti-extrusion rings were also tried but failed after one or two swages due to pressure and temperature during swaging operations. Rectangular steel anti-extrusion rings lasted longer, but the softer metal tubes were still damaged. Different metals were tried for the split rings, but none provided substantially better results for production applications.

BRIEF SUMMARY

In accordance with a preferred embodiment of the invention, polymeric anti-extrusion rings are provided for internal tooling of a drawbolt swaging apparatus. One such ring is located on either side of the elastomeric expansion sheath on a drawbolt. These anti-expansion rings are formed of polymeric material which has low creep, high tensile strength and is substantially unaffected at swaging temperatures. Preferred polymers are thermosetting or very high temperature thermoplastic polyimide resins. The rings are sized to fit snugly on the drawbolt shank and to provide minimum practical clearance with the interior dimensions of the tube to be swaged. Sizing the rings in this manner prevents unacceptable creep of the expander sheath during swaging. The outer perimeter of the rings adjacent to the drawbolt head and bushing, respectively, are chamfered to minimize permanent ring expansion. Unlike metal anti-extrusion rings, the subject polymeric rings do not require a break or split to operate effectively. Moreover, the life of these rings has been found to be substantially longer than any prior art rings and they do no damage to the interior of soft metal tubes.

The invention will be better understood in terms of the several figures and detailed description which follow.

DETAILED DESCRIPTION

FIG. 2 is a drawbolt swaging apparatus like that of FIG. 1 for making lightweight swaged unions.

FIG. 3 is a drawbolt swaging apparatus like that of FIG. 1 for making heavy duty swaged unions in which the tube to be swaged is, braced against the end bushing.

Figure 1:
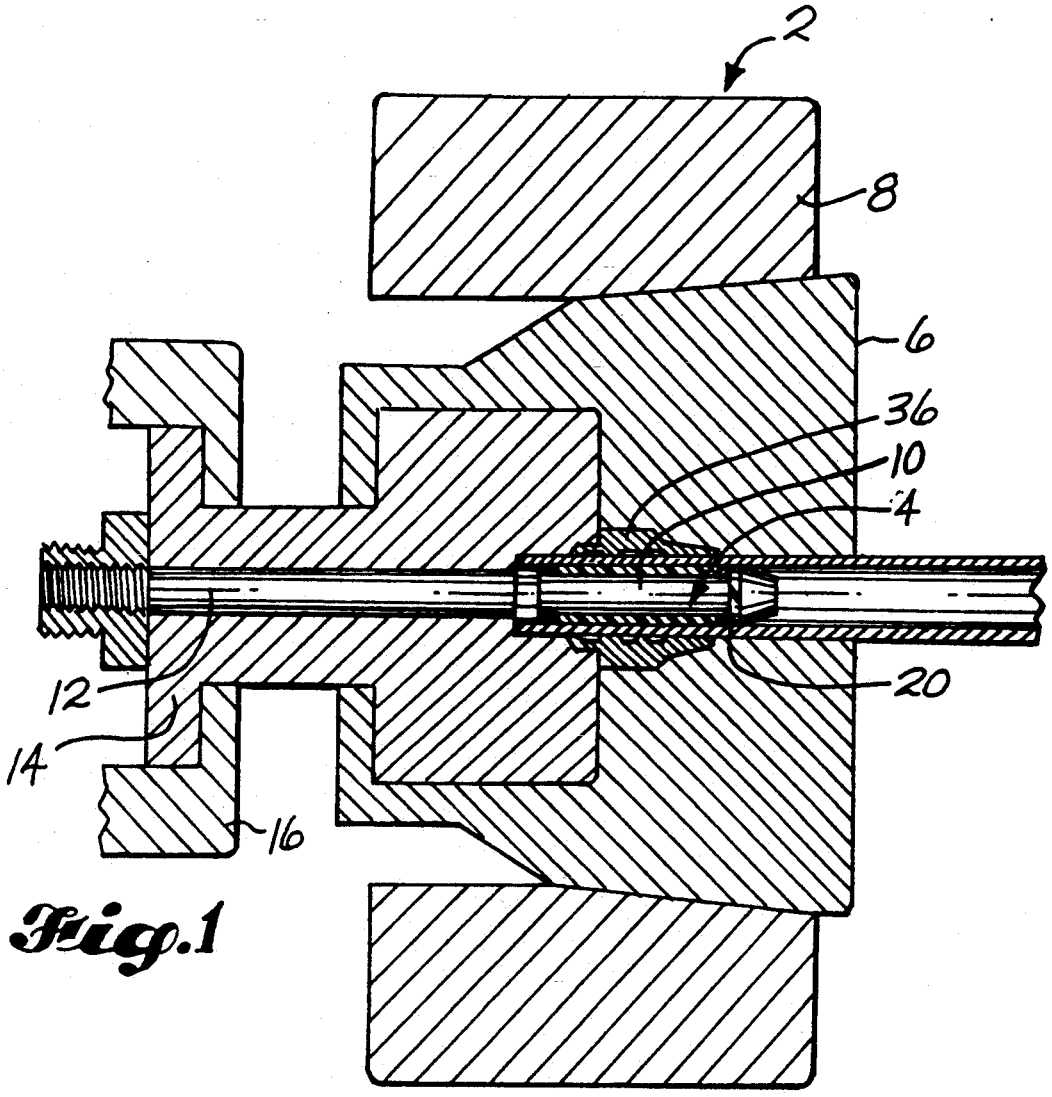
FIG. 1 is a cross sectional view of an apparatus for elastomeric swaging of tubes including a drawbolt, elastomeric expanding sheath, bushing, anti-extrusion rings, end fitting and swaging die.

Referring to FIG. 1, a cross section of a swaging apparatus 2 in accordance with the invention is shown. Apparatus 2 includes a drawbolt internal tooling 4 located within a three segment split swaging die 6 in die closing ring 8. Drawbolt 10 is actuated by reciprocation of rod 12 through a channel in anvil 14 retained in fixture 16.

Details of drawbolt internal tooling 4 can be better seen in FIG. 2. The assembly comprises a drawbolt 10 which has a shank 18 and an enlarged tapered head 20. Girth 22 of head 20 is sized to be in close tolerance with the interior surface 24 of tube 26. This prevents any extrusion of polymeric anti-extrusion ring 28 between tube 26 and tapered head 20 during the swaging process.

Shank 18 is surrounded by elastomeric expander 30. A second anti-extrusion ring 32 is located between expander 30 and bushing 34. Fitting 36 is positioned in die 6 and anvil 14. Cylindrical shaped grooves 38 are located in fitting 36 adjacent tube 26.

FIG. 3 is like FIG. 2 except that it is adapted for heavier duty swaging. Particularly, end 40 of tube 42 surrounds bushing 44 and is biased against ledge 46 of bushing 44.

The key feature of this invention is the use of specially adapted anti-extrusion rings 28 and 32. In the past, these rings were made of steel, preferably piano wire, and were split to accommodate stresses encountered during swaging without damage. The subject anti-extrusion rings are formed from a high performance polymer.

Figure 4:
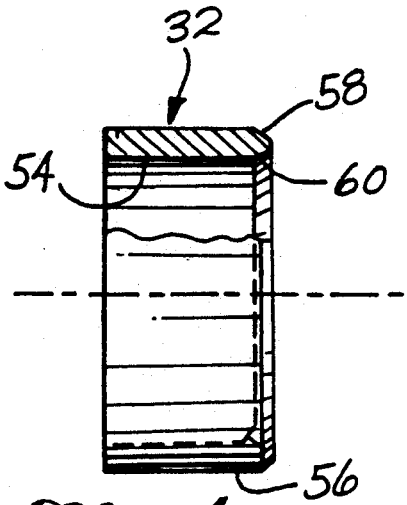
FIG. 4 is a side view of an anti-extrusion bushing in accordance with the invention.
Figure 5:
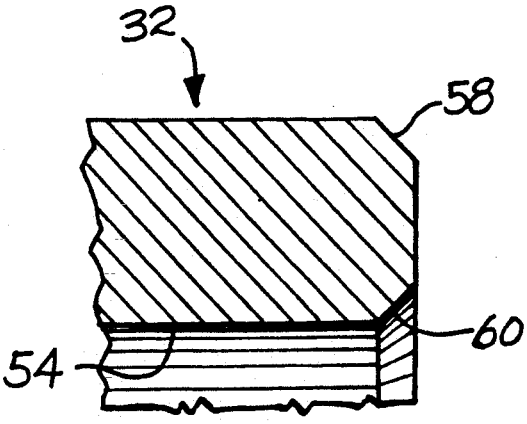
FIG. 5 is an expanded sectional view of the bushing of FIG. 4 taken at line 5.

A side view and a cross-sectional view of an a portion of anti-extrusion ring in accordance with the invention are shown in FIGS. 4 and 5, respectively. Referring to FIGS. 2, 4 and 5, rings 32 and 48 have similar size and a hollow cylindrical shape. Ring 32 is sized such that interior surface 54 fits snugly onto shank 18 of drawbolt 10. Outer surface 56 fits snugly into the tube to be swaged, preferably with a tolerance of 0.002 inch or less to prevent extrusion of expander 30 between shank 18 and ring 32, and between shank 18 and tube 26.

Outer edge 50 and inner edge 52 of ring 32 have chamfers 58 and 60. Ring 32 expands during swaging and then contracts when the pressure is relieved. As the material wears after multiple swaging, the chamfers are filled in preventing permanent expansion. A preferred chamfer size is 0.030 inch at an angle of 45° for a ⅜ inch aluminum tube.

Anti-extrusion rings of the subject invention are made of a polymeric material with good lubricity, high strength and a resistance to permanent deformation under high pressure. The preferred material is a polyimide polymer such as Vespel TM or Kapton TM sold by DuPont TM, Envex TM sold by Roger Chemical Co., or Kinel TM sold by Rhone Poulenc TM. Such polyimide resins may be thermoset or very high temperature thermoplastics. We have found that unfilled polymers are preferable. The rings may be machined or molded from the polymer resin. We have found that rings made of Vespel TM lasted between 250 and 300 swaging cycles for aluminum tubing where split steel anti-extrusion rings lasted only 10 to 15 cycles. Therefore, use of this invention can result in substantial cost savings.

Compared to prior art drawbolt swaging systems, a drawbolt for use in this invention has a relatively larger head that fits with a closer tolerance to the interior diameter of the tube to be swaged, preferably with a tolerance of 0.002 inch or less. The diameter of the shank is also reduced to allow the polymeric anti-extrusion rings to be as thick as possible.

While the invention has been described in terms of preferred embodiments thereof, other forms may be readily adapted by one skilled in the art. Therefore, the scope of our invention is to be limited only in accordance with the following claims.

We claim:

1. In an apparatus for swaging metal tubing, internal tooling comprising a drawbolt having a shank and an enlarged head; an elastomeric expander sheath around the shank; and a bushing surrounding the shank through which the drawbolt is moved to compress and expand the expander sheath, the improvement comprising a first anti-extrusion ring located between the drawbolt head and the expander sheath, the ring having an inside diameter such that it fits snugly on the shank, an outside diameter that is substantially equal to the inside diameter of the tubing to be swaged, and a chamfer on the outer perimeter of the ring adjacent to the drawbolt head; and a second anti-extrusion ring located between the expander sheath and the bushing, the second ring having an inside diameter such that it fits snugly on the shank, an outside diameter that is substantially equal to the inside diameter of the tubing to be swaged, and a chamfer on the outer perimeter of the second ring adjacent to the bushing; the first and second anti-extrusion rings being formed of a polyimide polymer.

2. The method of claim 1 wherein the metal of said tubing comprises one or more metals selected from the group consisting of copper, aluminum and alloys thereof.

3. In an apparatus for swaging metal tubing that could be damaged by split-steel anti-extrusion rings, internal tooling comprising a drawbolt having a shank and an enlarged head; and elastomeric expander sheath around the shank; and a bushing surrounding the shank through which the drawbolt is moved to compress and expand the expander sheath, the improvement comprising a first anti-extrusion ring located between the drawbolt head and the expander sheath, the ring having an inside diameter such that it fits snugly on the shank, and outside diameter that is substantially equal to the inside diameter of the tubing to be swaged, and a chamfer on the outer perimeter of the ring adjacent to the drawbolt head; and a second anti-extrusion ring located between the expander sheath and the bushing, the second ring having an inside diameter such that it fits snugly on the shank, an outside diameter that is substantially equal to the inside diameter of the tubing to be swaged, and a chamfer on the outer perimeter of the second ring adjacent to the bushing; the first and second anti-extrusion rings being formed of a polymeric material having strength and resistance to permanent deformation under high pressure commensurate with such properties in polyimide polymers.

4. The method of claim 3 where the metal of said tubing comprises one or more metals selected from the group consisting of copper, aluminum and alloys thereof.

* * * * *